US005921330A

United States Patent [19]

Sue et al.

[11] Patent Number: 5,921,330

[45] Date of Patent: Jul. 13, 1999

[54] ROCK BIT WITH WEAR-AND FRACTURE-RESISTANT HARDFACING

[75] Inventors: Jiinjen Albert Sue; Zhlgang Fang, both of The Woodlands; Alysia C. White, Kingwood, all of Tex.

[73] Assignee: Smith International, Inc., Houston, Tex.

[21] Appl. No.: 08/815,746

[22] Filed: Mar. 12, 1997

[51] Int. Cl.[6] ..... E21B 10/46

[52] U.S. Cl. ..... 175/374; 175/425; 51/309

[58] Field of Search ..... 175/374, 341, 175/343, 348, 378, 425; 51/309

[56] References Cited

U.S. PATENT DOCUMENTS

| | | | |
|---|---|---|---|
| 3,842,921 | 10/1974 | Dill et al. | 175/374 |
| 4,836,307 | 6/1989 | Keshavan et al. | 175/374 |
| 4,944,774 | 7/1990 | Keshavan et al. | 51/309 |
| 5,152,194 | 10/1992 | Keshavan et al. | 76/108.2 |
| 5,250,355 | 10/1993 | Newman et al. | 428/367 |
| 5,351,771 | 10/1994 | Zahradnik | 175/374 |
| 5,355,750 | 10/1994 | Scott et al. | 76/108.2 |
| 5,492,186 | 2/1996 | Overstreet et al. | 175/374 |
| 5,639,285 | 6/1997 | Yao et al. | 51/307 |
| 5,791,422 | 8/1998 | Liang et al. | 175/374 |
| 5,830,813 | 11/1998 | Yao et al. | 501/87 |

*Primary Examiner*—Frank Tsay
*Attorney, Agent, or Firm*—Christie, Parker & Hale, LLP

[57] ABSTRACT

An improved hardfacing for teeth and other surfaces of milled tooth rock bits comprises a hard phase of carbide particles embedded in a toughened steel matrix containing no more than 10 percent by volume of combined eta phase and oxide particle components. Eta phase and oxide particle formation is minimized during oxyacetylene welding by positioning the weld rod in a preferred region of the torch flame while welding the hardfacing to the rock bit. The matrix is strengthened by uniformly dispersing ultra-fine carbide or boride particles in the steel alloy. The hardfacing is further toughened by selecting tough carbide particles for the hard phase. Accordingly, the hard phase comprises spherical cast carbide and spherical cemented carbide particles having particle sizes in the range of from 75 $\mu$m to 590 $\mu$m.

26 Claims, 1 Drawing Sheet

11
10
13
15
13
12
12
14G
14
16

18
17
16
19

ROCK BIT WITH WEAR-AND FRACTURE-RESISTANT HARDFACING

FIELD OF THE INVENTION

This invention relates to improved wear-resistant and fracture resistant hardfacing compositions applied to wear surfaces on teeth on bits for drilling oil wells or the like.

BACKGROUND OF THE INVENTION

Bits for drilling oil wells and the like commonly have a steel body which is connected at the bottom of a drill string. Steel cutter cones are mounted on the body for rotation and engagement with the bottom of a hole being drilled to crush, gouge, and scrape rock for drilling the well. One important type of rock bit referred to as a milled tooth bit has roughly triangular teeth protruding from the surface of the cone for engaging the rock. The principal faces of such a milled tooth that engage the rock are usually dressed with a layer of hardfacing material to resist wear. The specific tooth geometry forms no part of this invention.

Conventional hardfacing usually comprises particles of tungsten carbide bonded to the steel teeth by a metal alloy. In effect, the carbide particles are embedded in a matrix of metal forming a layer on the surface. Most hardfacing on rock bits employs steel alloys containing nickel and cobalt as the matrix, although other alloys may also be used.

It is quite common in referring to the particulate material in the hardfacing merely as "carbide" without characterizing it as tungsten carbide. The metal carbide principally used in hardfacing is tungsten carbide. Small amounts of tantalum carbide and titanium carbide may be present, although considered to be deleterious. It will be understood that as used herein, reference merely to "carbide" means tungsten carbide.

Three types of tungsten carbide have been employed for hardfacing. Possibly the most common is crushed cast carbide. Tungsten forms two carbides, WC and $W_2C$ and there can be an essentially continuous range of compositions therebetween. Cast carbide is typically a eutectic mixture of the WC and $W_2C$ compounds, and as such is substoichiometric, that is, it has less carbon than the more desirable WC form. Cast carbide is solidified from the molten state and comminuted to the desired particle size.

Another type of tungsten carbide is so-called macrocrystalline tungsten carbide. This material is essentially stoichiometric WC in the form of single crystals. Most of the macrocrystalline tungsten carbide is in the form of single crystals but some bicrystals of WC may form in larger particles.

The third type of tungsten carbide used in hardfacing comprises cemented tungsten carbide, sometimes referred to as sintered tungsten carbide. Cemented tungsten carbide comprises small particles of tungsten carbide (e.g., 1 to 15 microns) bonded together with cobalt. Cemented tungsten carbide is made by mixing tungsten carbide and cobalt powders, pressing the mixed powders to form a green compact, and "sintering" the composite at temperatures near the melting point of cobalt. The resulting dense cemented carbide can then be comminuted to form particles of cemented tungsten carbide for use in hardfacing.

A typical technique for applying hardfacing to the teeth on a rock bit is by oxyacetylene welding. A welding "rod" or stick is formed of a tube of mild steel sheet enclosing a filler which is primarily carbide particles. The filler may also include deoxidizer for the steel, flux, and a resin binder to retain the particles in the tube during welding. The hardfacing is applied by melting the rod on the face of the tooth. The steel tube melts to weld to the steel tooth and provides the matrix for the carbide particles in the hardfacing. The deoxidizer alloys with the mild steel of the tube.

Although mild steel sheet is used when forming the tubes, the steel in the hardfacing as applied to a rock bit is a hard, wear resistant, alloy steel. This occurs by the dissolution of tungsten, carbon, and possibly cobalt, into the alloy steel from the tungsten carbide during welding. There may also be some mixing with the alloy steel from the teeth on the cone.

It is important to provide as much wear resistance as possible on the teeth of a rock bit cutter cone. The effective life of the cone is enhanced as wear and fracture resistance of the hardfacing is increased. It is desirable to keep the teeth protruding as far as possible from the body of the cone since the rate of penetration of the bit into the rock formation is enhanced by longer teeth (however, unlimited length is infeasible since teeth may break if too long for a given rock formation). As wear occurs on the teeth, they get shorter and the drill bit may be replaced when the rate of penetration decreases to an unacceptable level. It is desirable to minimize wear so that the footage drilled by each bit is maximized. This not only decreases direct cost, but also decreases the frequency of having to "round trip" a drill string to replace a worn bit with a new one.

One wear mechanism of the hardfacing material during drilling, and the dominant wear mechanism on the outer row of teeth, also referred to as the heel or gage row, is sliding abrasion wear. This occurs as the teeth rub against the wall or "gage" of the borehole being drilled. Similar abrasion wear occurs on the flank and side surfaces of the teeth where drilling debris, e.g., sand, runs between the teeth. Abrasion wear is minimized in the hardfacing by providing very hard carbide particles and a hardened alloy steel matrix.

Another wear mechanism of the teeth is flaking or chipping of the hardfacing on the crest of the teeth of the inner and gage rows, which can lead to cratering of the hardfacing material which can dramatically reduce the life of the bit. Chipping and flaking of the hardfacing result from gross fracture in the matrix and the carbide particles. Local chipping of the matrix surrounding the carbide particles may result in the dislodging, or pull-out, of the carbide particles which is responsible for cratering in the hardfacing. Cratering results in substantial loss of the hardfacing material during drilling which leads to exposure of the relatively soft base metal of the teeth and subsequent rapid wear. As a result, the drilling efficiency is greatly reduced. Therefore, in addition to improving the hardness of the hardfacing material, it is important to improve the chipping resistance of the matrix and the carbide particles, especially at the crest of the teeth.

Due to the different types of wear mechanisms on the teeth—cratering at the crest and abrasion wear on the side and flank surfaces—it is important to improve the wear resistance and fracture toughness of both the matrix and hard phase, e.g., the carbide particles, of the hardfacing material to enhance the footage which a drill bit can drill before becoming dull, and to enhance the rate of penetration of such drill bits. Such improvements translate directly into reduction of drilling expense.

BRIEF SUMMARY OF THE INVENTION

The present invention is directed to an improved hardfacing material for both an inner row and gage row of rock bit teeth comprising a steel matrix in the range of from 45 to 70 percent by volume which includes alloy steel and no more than 10 percent by volume of a combined eta phase and oxide particle component, and a hard phase in the range of from 30 to 55 percent by volume comprising carbide particles. Preferably, the hardfacing material is 50 to 65 percent by volume matrix material and 35 to 50 percent by volume hard phase particles. The hard phase may include cemented, cast, or macrocrystalline carbide particles, but preferably comprises spherical cast or spherical cemented carbide particles having particle sizes between about 28 and 200 mesh, i.e., in the range of from about 75 $\mu$m to 590 $\mu$m.

In another embodiment, the matrix is strengthened by including ultra-fine carbide particles in the range of from 5 to 40 percent by volume and preferably in the range of from 7 to 15 percent by volume. The ultra-fine particles have a particle size between about 1 and 50 microns with a preferable mean particle size of about 15–30 microns.

A preferred method for applying the hardfacing to the teeth is by welding hardfacing material in a tube rod to the teeth with an oxyacetylene torch having an intermediate flame cone about four times the length of an inner flame cone, with the tube rod maintained in a preferred region of the intermediate flame. It is preferred to hold the rod at a location away from the tip of the torch in the range of from 1.5 to 3 times the length of the inner cone of the flame. For a number 6 or 7 torch tip, this preferred region is between the two cone tips at a distance of between about 1 to 4 cm from the inner cone tip.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION

Figure 1:
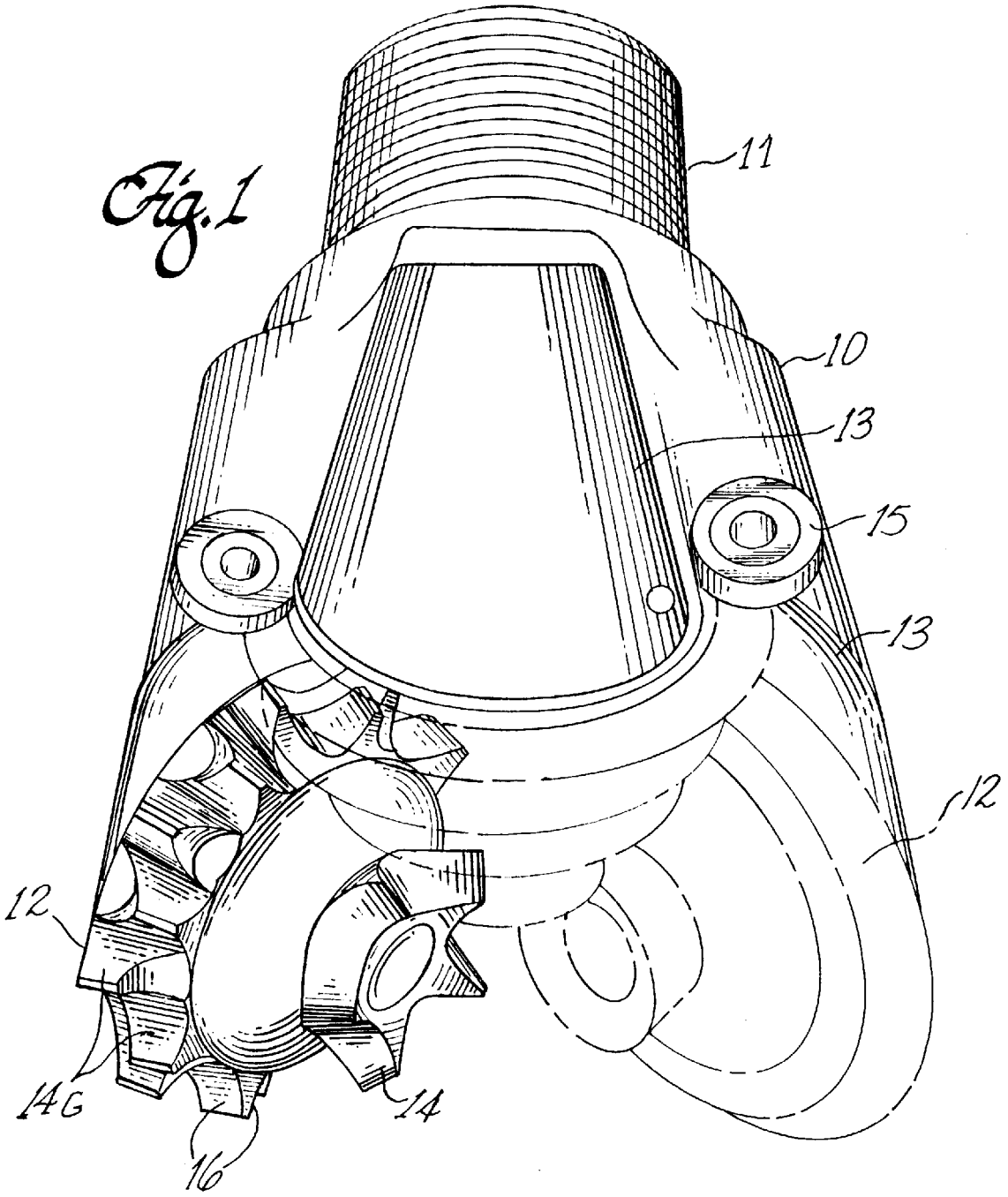
FIG. 1 is a perspective view of a milled tooth rock bit constructed according to principles of this invention.
Figure 2:
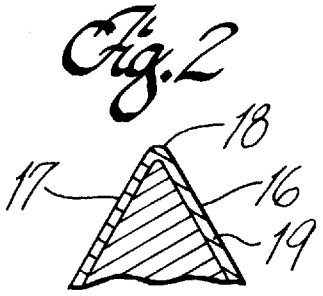
FIG. 2 is a fragmentary cross section of an exemplary tooth on such a rock bit.

An exemplary milled tooth rock bit comprises a stout steel body 10 having a threaded pin 11 at one end for connection to a conventional drill string. At the opposite end of the body there are three cutter cones 12 for drilling rock for forming an oil well or the like. Each of the cutter cones is rotatably mounted on a pin (hidden) extending diagonally inwardly on one of the three legs 13 extending downwardly from the body of the rock bit. As the rock bit is rotated by the drill string to which it is attached, the cutter cones effectively roll on the bottom of the hole being drilled. The cones are shaped and mounted so that as they roll, teeth 14 on the cones gouge, chip, crush, abrade, and/or erode the rock at the bottom of the hole. The teeth 14G in the row around the heel of the cone are referred to as the gage row teeth. They engage the bottom of the hole being drilled near its perimeter on "gage." Fluid nozzles 15 direct drilling mud into the hole to carry away the particles of rock created by the drilling.

Such a rock bit is conventional and merely typical of various arrangements that may be employed in a rock bit. For example, most rock bits are of the three cone variety illustrated. However, one, two and four cone bits are also known. The arrangement of teeth on the cones is just one of many possible variations. In fact, it is typical that the teeth on the three cones on a rock bit differ from each other so that different portions of the bottom of the hole are engaged by the three cutter cones so that collectively the entire bottom of the hole is drilled. A broad variety of tooth and cone geometries are known and do not form a specific part of this invention.

Exemplary teeth on such a cone are generally triangular in a cross-section taken in a radial plane of the cone. Such a tooth has a leading flank 16 and trailing flank 17 meeting in an elongated crest 18. The flanks of the teeth are covered with a hardfacing layer 19. Sometimes only the leading face of each tooth is covered with a hardfacing layer so that differential erosion between the wear-resistant hardfacing on the front flank of a tooth and the less wear-resistant steel on the trailing face of the tooth tends to keep the crest of the tooth relatively sharp for enhanced penetration of the rock being drilled.

The leading face of the tooth is the face that tends to bear against the undrilled rock as the rock bit is rotated in the hole. Because of the various angles of teeth on a cutter cone relative to the angle of the pin on which the cone is mounted, the leading flank on the teeth in one row on the same cone may face in the direction of rotation of the bit, whereas the leading flank on teeth in another row on the same cone may face away from the direction of rotation of the bit. In other cases, particularly near the axis of the bit, neither flank can be uniformly regarded as the leading flank and both flanks may be provided with a hardfacing.

There are also times when the ends of a tooth, that is, the portions facing in more or less an axial direction on the cone, are also provided with a layer of hardfacing. This is particularly true on the so-called gage surface of the bit which is virtually always provided with a hardfacing. The gage surface is a generally conical surface at the heel of a cone which engages the side wall of a hole as the bit is used. The gage surface includes the outer end of teeth 14G in the so-called gage row of teeth nearest the heel of the cone and may include additional area nearer the axis of the cone than the roots between adjacent teeth. The gage surface is not considered to include the leading and trailing flanks of the gage row teeth. The gage surface encounters the side wall of the hole in a complex scraping motion which induces abrasion wear of the gage surface.

The inner row teeth 14 work under very high and complex compressive stresses when crushing, gouging, and scraping rock for drilling the well. These complex stresses in combination with the heat generated by the work of the teeth on the rock, especially at the crest of the teeth, tend to cause the initiation of fatigue cracks in the steel matrix of the hardfacing and subsequent loss of the hardfacing due to gross fracture and chipping. Wear of the steel matrix leaves carbide particles exposed and unsupported for possible fracture. "Pull-out" or dislodging of the carbide particles occurs when the matrix surrounding the carbide particles is worn away to a point at which it can no longer secure the particles. One way of enhancing wear resistance of the matrix is to make it stronger and harder. An alloy steel binder with ultra-fine tungsten carbide dispersion as used in practice of this invention provides such hardness and strength while retaining sufficient chipping and wear resistance to prevent loss of hardfacing material due to fracture and wear.

It is hypothesized that the presence of eta phase and oxide particles in the matrix formed as a by-product of the welding process reduces the toughness of the matrix. Eta phase and oxide particles form in the steel matrix during welding due to the presence of excessive oxygen in the torch flame. The eta phase particles, e.g., $W_3\ Fe_3C$ and $W_3\ Co_3C$, are the result of carbon depletion of the tungsten carbide as it reacts with the metals in the matrix. Oxide particles form when the metal alloy in the tube rod reacts with the carbide particles and the oxygen in the oxyacetylene torch flame or from the air surrounding the flame. The eta phase and oxides are brittle compounds. Thus a matrix containing a large portion of eta phase and oxide particles tends to be brittle and more prone to fracture. It has been found that the formation of eta phase and oxide particles in the steel matrix can be minimized by controlling the welding parameters when applying the hardfacing.

Hardfacing is applied to the teeth and gage surfaces by welding, preferably with an oxyacetylene torch, a "rod" in the form of a mild steel tube containing the larger particles of mixed cemented tungsten carbide, cast carbide and/or macrocrystalline carbide and ultra-fine carbide particles having a particle size between about 1 and 50 $\mu$m as will be further discussed below. However, it is to be understood within the scope of this invention that methods other than that specifically described, such as plasma transferred arc, gas tungsten arc, shield metal arc processes and other thermal deposition processes, can be used to apply the hardfacing material of this invention.

An oxyacetylene torch flame has inner, intermediate and outer flame cones. Combustion of acetylene occurs in two stages. The first stage:

$$2C_2H_2+2O_2 \rightarrow 4CO+2H_2$$

uses the oxygen and acetylene supplied from the cylinder. The oxygen-acetylene mixture is achieved and controlled in the torch. This reaction can be seen as the small inner cone of the flame. The highest temperature is at the point of this cone. The second stage:

$$4CO+2H_2+3O_2 \rightarrow 4CO_2+2H_2O$$

uses oxygen supplied from the air surrounding the flame. This combustion zone constitutes the outer blue envelope of the flame. Intermediate between the inner and outer cones there is a non-luminous intermediate cone. When the acetylene/oxygen ratio is about 1 to 1 and there is neither excess oxygen nor acetylene at the tip of the inner cone, the intermediate cone of the flame is regarded as neutral, i.e neither oxidizing nor carburizing. A short pale green "feather" at the tip of the inner cone is an indication of an excess of acetylene. When the feather is less than about half the length of the inner cone, the flame is regarded as reducing. A longer intermediate flame is considered carburizing.

A neutral flame showing only three cones without a feather or only a very short feather less than about ⅛ the length of the inner cone is preferred for welding hardfacing on the teeth of a rock bit cutter cone. The oxygen concentration within the intermediate cone in a neutral flame is quite low and oxides should not be formed when the molten metal is within the outer cone and outside the inner cone. A torch configuration to yield a pointed inner cone is preferred over a configuration that yields a bulbous cone.

Previously, when welding the hardfacing material onto a rock bit, the ratio of lengths of the intermediate and inner flame cones is typically maintained at about 3:1, with the end of the tube rod maintained in a region between the tips of these two flame cones, most likely near the tip of the inner cone since that is the location of the highest temperatures. Welders prefer to hold the tip of the inner cone near the workpiece since welding is faster. A flame ratio of about 3:1 is specified in welding handbooks.

According to a presently preferred embodiment for welding hardfacing onto the teeth of a cutter cone, the intermediate to inner flame cone length ratio is maintained at about 4:1 and the tube rod is maintained in a preferred region of the intermediate flame cone away from the tip of the torch between about 1½ and 3 times the length of the inner cone. Hardfacing is welded onto rock bit cones using various torch tip sizes. For example, Victor welding torches, manufactured by the Thermadyne Company, have a number 6 and a number 7 size torch tip with orifice diameters of 0.27 cm and 0.32 cm, respectively. With a number 7 tip the typical length of the inner cone is about 2 to 2.5 centimeters. With a number 6 or 7 tip, it is preferred to hold the tube rod in the range of from about 1 to 4 centimeters from the tip of the inner cone. If anything, this region of the flame is neutral or slightly carbon-rich and produces lesser or no carbon-reduction of the metal carbide being welded by providing excess carbon for the chemical reactions between the metal and cermet materials in the hardfacing. By maintaining the tube rod in this preferred location in a longer than usual flame, eta phase and oxide particle formation in the matrix is minimized. In the welding practice according to this embodiment of the invention, the formation of oxide and eta phase particles is insensitive to increases in heat input of the flame, unlike conventional welding practices in which oxide and eta phase particle formation increases with increases in heat input from the flame. In addition, the particle size of the eta phase and oxide particles is greatly refined to less than 15 $\mu$m compared to greater than 20 $\mu$m of the prior art process.

The length of the intermediate cone relative to the inner cone, and the neutral condition of the flame are readily adjusted by varying the pressure or flow rate of the oxygen and acetylene to the torch. This can be accomplished by pressure regulators at the tanks and/or adjustment of the valves on the torch.

A preferred region for the welding rod in a torch flame having 3:1 ratio of cone lengths is between about one to two cm from inner flame cone tip; however it is difficult to maintain the tube rod in this small range during manual welding. Hence, this is a less preferred method of hard facing. The longer than usual flame with a 4:1 ratio provides a much longer zone within which the welding rod may be placed for achieving a low eta phase and oxide concentration in the matrix of the hardfacing.

The eta phase and oxide content in the matrix may be determined by polishing a cross-section of a tooth with hardfacing with incrementally decreasing sizes of diamond particles from 40 $\mu$m to 3 $\mu$m. The polished surface is then etched with a reagent of 10 g $KFe(CN)_6$, 10 g KOH and 100 ml water followed by an alcohol rinse. The eta phase and oxide content may be determined using a PGI Imagist image analyzer at 100×magnification.

It has been found that the metal matrix may be strengthened by uniformly dispersing ultra-fine carbide particles in the steel matrix without sacrificing toughness. The ultra-fine particles may be a carbide, such as chromium, vanadium or niobium carbide, or a boride such as chromium boride. As used herein, the term "ultra-fine" is defined with respect to the particle size of distinct carbide particles incorporated in the metal matrix as practiced in the prior art, as opposed to carbide particles incorporated in larger carbide particles, such as in cemented tungsten carbide particles as described below. The hypothesized mechanism for this strengthening is dispersion strengthening of the steel matrix. As a result, the wear resistance of the steel matrix is increased and the overall chipping resistance is markedly improved. The ultra-fine carbides to be dispersed in the steel matrix according to alternate preferred embodiments of the present invention may be formed either by a macrocrystalline tungsten carbide process, or by a process in which very small tungsten particles, e.g., 1–50 μm, are carburized from tungsten metal to produce a type of tungsten carbide powder generally referred to as carburized carbide. The shape of the ultra-fine carbide particles may be angular or spherical as spherical cast tungsten carbide particles in this preferred size range may also be used for the ultra-fine particles. In a presently preferred embodiment, the ultra-fine particles are included in the hardfacing as a carburized carbide powder containing tungsten carbide particles in the range of from about 15 to 50 μm. A suitable powder containing ultra-fine carbide particles is available from H. C. Stark as MAS-3000 powder. The ultra-fine carbide particles may be introduced directly into the matrix by mixing them with the other carbide particles in the tube rod to be welded. Alternatively, the ultra-fine particles may be uniformly distributed in the matrix by sufficiently overheating the tube rod during welding to induce dispersion of the ultra-fine particles which comprise the cemented carbide particles, causing them to migrate through the matrix by convection.

Carbide particle fracture is another significant wear mechanism which can likely lead to cratering in the hardfacing. According to a further embodiment, such fracturing is reduced by providing tougher carbide particles. One type of carbide particles to be used includes cemented tungsten carbide. As used herein, cemented tungsten carbide refers to a material formed by mixing ultra-fine particles of tungsten carbide, e.g., 1 to 15 microns, and particles of cobalt or other iron group metal, and sintering the mixture. In a typical process for making cemented tungsten carbide, carbide and cobalt particles are vigorously mixed with a small amount of organic wax which serves as a temporary binder. An organic solvent may be used to promote uniform mixing. The mixture may be prepared for sintering by either of two techniques: it may be pressed into solid bodies often referred to as green compacts; alternatively, it may be formed into granules or pellets such as by pressing through a screen, or tumbling and then screened to obtain more or less uniform pellet size.

Such green compacts or pellets are then heated in a vacuum furnace for first evaporating the wax and then to a temperature near the melting point of cobalt (or the like) which causes the tungsten carbide particles to be bonded together by the metallic phase. After sintering, the compacts are crushed and screened to a desired particle size. The sintered pellets tend to bond together during sintering and are crushed to break them apart. These are also screened to obtain a desired particle size.

In an alternate embodiment, the ultra-fine particles are uniformly distributed in the matrix by sufficiently overheating the tube rod during welding to induce dispersion of the ultra-fine particles which comprise the cemented carbide particles, causing them to migrate through the matrix by convection. Therefore, the size of the dispersed carbide particles is in the range of 1 to 15 μm, equivalent to the carbide size in the cemented carbide pellets used in the tube rod.

Another type of carbide particles to be used in the hardfacing is cast tungsten carbide which has approximately the eutectic composition between bitungsten carbide, $W_2C$, and monotungsten carbide, WC. The cast carbide is typically made by resistance heating tungsten in contact with carbon in a graphite crucible having a hole through which the resultant eutectic mixture drips. The liquid is quenched in a bath of oil and is subsequently comminuted to a desired particle size. The crushed eutectic is what is known as cast carbide.

Yet another type of tungsten carbide is so-called macrocrystalline tungsten carbide. This material is essentially stoichiometric WC in the form of single crystals. Most of the macrocrystalline tungsten carbide is in the form of single crystals but some bicrystals of WC may form in larger particles.

The shape of the carbide particles has been found to affect their toughness. Both cemented carbide and cast carbide may be formed into spherical particles. Spherical particles of these carbides have been found to be tougher than crushed particles of cemented, cast, or macro-crystalline carbide. Such spherical particles lack the sharp edges found in crushed particles, which act as stress concentrators and are likely microcrack initiation sites.

In a further alternative embodiment, the overall particle size of the carbide particles is much smaller than that of the carbide particles used in the prior art. The smaller particles more readily disperse stress-inducing energies, e.g., heat and compressive or impact forces, into the matrix. The incidence of particle fracture is thus reduced by reducing the average particle size. Also, with more particles in the matrix, fracture of individual particles has less effect on the overall structure of the hardfacing.

Thus, according to a presently preferred embodiment, the hardfacing material comprises a bimodal or trimodal distribution of relatively large spherical particles of cemented and/or intermediately sized spherical cast carbide particles, and ultra-fine carbide particles to strengthen the matrix. The carbide particles are in a matrix of alloy steel welded to the alloy steel of the teeth of the cutter cone in such a manner as to minimize eta phase and oxide particle formation in the matrix. The proportions of these components in the hardfacing material is matrix material in the range of from 45 to 70 percent by volume which includes alloy steel and no more than 10 percent by volume of a combined eta phase and oxide particle component, and hard phase material in the range of from 30 to 55 percent by volume comprising tungsten carbide particles. Less than about 45 percent by volume alloy steel in the hardfacing is not sufficient to adequately bind the carbide particles in the matrix. On the other hand, if the hardfacing contains greater than about 70 percent by volume alloy steel, it will be too soft and will not provide adequate wear resistance and protection for the underlying steel of the rock bit.

In an exemplary embodiment, the thickness of the hardfacing layer is about 1/16 to 5/32 inch (1.6 to 4 mm). Dissolution of silico-manganese into the mild steel of the tube, possible dissolution of some of the tungsten, carbon, and cobalt of the carbides, and mixing of metal from the body of the cutter cone results in an alloy steel matrix for the carbide particles.

The proportion of carbide in the hardfacing is determined largely by the proportion in the welding "rod" used for applying the hardfacing. Some dilution may occur by alloy steel from the surface of the tooth on the cutter cone. This dilution is not a large contributor since in a typical application of hardfacing to a milled tooth cutter cone for a rock bit, the thickness of hardfacing is in the order of 2 to 3 mm. The amount of dilution depends to some extent on the technique employed by the welder applying the hardfacing.

In a presently preferred embodiment, a steel tube rod is filled with a mixture of carbide particles. Presently preferred alternate ratios are provided in the following table:

| Example | Spherical Cemented Carbide (wt %) 420–590 μm | 75–300 μm | Spherical Cast Carbide (wt %) 75–150 μm | Ultra-fine Carbide (wt %) 30 μm | Wt % of the filled-in tube rod |
|---|---|---|---|---|---|
| 1 | 70 | — | 20 | 10 | 64 |
| 2 | — | 35 | 45 | 20 | 64 |
| 3 | 40 | — | 50 | 10 | 70 |

The weight percentage of the filled-in tube rod in the above chart may include up to 4% fluxing agent and deoxidizer. A suitable deoxidizer is disclosed is U.S. Pat. No. 4,836,307 which is hereby incorporated by reference.

As noted above, the hardfacing material is preferably applied to the faces of a tooth by heating the face to a welding temperature by an oxyacetylene torch. When a suitable temperature is reached, the above-described tubular welding "rod" is melted onto the face of the tooth.

The hardfacing Examples 1–3 described in the above chart were applied to various sizes of drilling bits and compared to milled tooth rock bits used in offset drilling sites which inporated the hardfacing material disclosed in U.S. Pat. No. 4,944,774. These bits were tested at various locations including Texas and Louisiana, USA, and Alberta, Canada. The overall performance of Example 1 was above average. Compared to the offset bits, the 7⅞-inch milled-tooth rock bits incorporating the hardfacing of Example 1 which ran in Central Alberta, Canada showed improved appearance after the same footage of drilling. In the south Texas area, the 9⅞ inch bits incorporating the hardfacing of Example 1 resulted in about a 25% to 50% increase in footage drilled, while the 12¼-in bits incorporating the hardfacing of Example 1 drilled up to 29.3% further than the offset bits. In the Louisiana area, a 12¼-inch bit incorporating the hardfacing of Example 1 showed a 65% increase in footage with improved appearance after drilling compared to the offset bits.

The drilled footage bits incorporating the hardfacing of Examples 2 and 3 bits were increased by up to 20% compared to the offset bits and also showed significantly improved appearance after drilling.

The improvement in performance of the improved hardfacing is believed due to the contribution of the ultra-fine particles in the matrix which strengthen and improve wear resistance of the matrix, the minimizing of the eta phase and oxides in the matrix and the resultant improvement in chipping and wear resistance, and the use of tougher, more fracture resistant carbide particles.

Other modifications and variations of hardfacing for a rock bit will be apparent to one skilled in the art. For example, the formation of oxides may be precluded by arc welding the hardfacing onto the bit in an oxygen-free environment. Also, carbon reduction of the tungsten carbide may be offset by providing an extra carbon component such as carbon black in the tube rod. It is therefore to be understood that the scope of the invention should be limited only by the appended claims; wherein:

What is claimed is:

1. A rock bit comprising:

a body;

at least one cutting cone rotatably mounted to an end of the body, wherein the cone includes a gage surface at a heel portion of the cone; and a number of teeth on the cone, the teeth including a plurality of inner row teeth and a plurality of gage row teeth located near a heel of each cone, wherein the teeth include a hard facing comprising:

a matrix material in the range of from 45 to 70 percent by volume comprising steel and no more than 10 percent by volume of a combined eta phase and oxide component; and a hard phase in the range of from 30 to 55 percent by volume comprising tungsten carbide particles.

2. A rock bit as recited in claim 1 wherein the hardfacing comprises the matrix material in the range of from 45 to 60 percent by volume and the hard phase in the range of from 40 to 55 percent by volume.

3. A rock bit as recited in claim 1 wherein the tungsten carbide particles are selected from the group consisting of cemented tungsten carbide, cast tungsten carbide, macrocrystalline tungsten carbide, and carburized carbide.

4. A rock bit as recited in claim 3 wherein the group further comprises spherical cemented tungsten carbide and spherical cast tungsten carbide.

5. A rock bit as recited in claim 4 comprising spherical cemented tungsten carbide particles having a particle size between about 75 μm to 590 μm.

6. A rock bit as recited in claim 4 comprising spherical cemented tungsten carbide particles having a particle size between about 75 μm to 300 μm.

7. A rock bit as recited in claim 4 comprising spherical cast tungsten carbide particles having a particle size between about 75 μm to 150 μm.

8. A rock bit as recited in claim 1 wherein the matrix material comprises ultra-fine tungsten carbide particles in the range of from 5 to 40 percent by volume of the matrix material, the particles having a particle size in the range of from about 1 to 50 microns.

9. A rock bit as recited in claim 8 wherein the matrix material is dispersion strengthened.

10. A rock bit as recited in claim 8 wherein the ultra-fine carbide particles have an average particle size of between about 15 and 30 microns.

11. A rock bit as recited in claim 8 wherein the matrix material comprises ultra-fine carbide particles in the range of from 7 to 15 percent by volume of the matrix material.

12. A rock bit as recited in claim 1 wherein the eta phase and oxide component comprises particles having a particle size smaller than about 15 microns.

13. A rock bit comprising:

a body;

at least one cutting cone rotatably mounted to an end of the body, wherein the cone includes a gage surface at a heel portion of the cone; and a number of teeth on the cone, the teeth including a plurality of inner row teeth and a plurality of gage row teeth located near a heel of each cone, wherein the teeth include a hard facing comprising:

a matrix material in the range of from 45 to 70 percent by volume comprising:

an alloy including metals selected from the group iron, nickel, and cobalt;

a particulate component comprising ultra-fine particles having a particle size between about 1 and 50 microns; and a hard phase in the range of from 30 to 55 percent by volume comprising carbide particles.

14. A rock bit as recited in claim 13 wherein the ultra-fine particles are selected from the group consisting of carbides and borides.

15. A rock bit as recited in claim 14 wherein the carbides are selected from the group consisting of chromium carbide, vanadium carbide, and niobium carbide.

16. A rock bit as recited in claim 14 wherein the ultra-fine particles comprise chromium boride.

17. A rock bit as recited in claim 13 wherein the ultra-fine particles are selected from the group consisting of carburized carbide, macrocrystalline carbide, and spherical cast tungsten carbide.

18. A rock bit as recited in claim 13 wherein the hard phase comprises carbide particles selected from the group consisting of cemented, cast, and macrocrystalline carbides.

19. A rock bit as recited in claim 13 wherein the matrix material is dispersion strengthened.

20. A rock bit comprising:

a body;

at least one cutting cone rotatably mounted to an end of the body, wherein the cone includes a gage surface at a heel portion of the cone; and a number of teeth on the cone, the teeth including a plurality of inner row teeth and a plurality of gage row teeth located near a heel of each cone, wherein the teeth include a hard facing comprising:

a steel matrix in the range of from 26 to 40 percent by volume comprising an alloy including metals selected from the group iron, nickel, and cobalt;

a carbide component in the range of from 60 to 74 ; percent by volume comprising ultra-fine tungsten carbide particles having a particle size in the range of from about 1 to 50 microns and larger tungsten carbide particles having a particle size between about 75 $\mu$m to 590 $\mu$m; and an eta phase and oxide component comprising particles having a particle size smaller than about 15 $\mu$m.

21. A rock bit as recited in claim 20 wherein the ultra-fine particles are selected from the group consisting of carburized carbide, macrocrystalline carbide, and spherical cast tungsten carbide.

22. A rock bit as recited in claim 20 wherein the relatively larger tungsten carbide particles are selected from the group consisting of cemented, cast, and macrocrystalline carbides.

23. A rock bit as recited in claim 20 wherein the matrix material is dispersion strengthened.

24. A rock bit as recited in claim 20 wherein the carbide component consists essentially of about 70 percent by weight spherical cemented carbide particles having a particle size between about 420 $\mu$m and 590 $\mu$m, 20 percent by weight spherical cast carbide particles having a particle size between about 75 $\mu$m and 150 $\mu$m, and 10 percent by weight carburized carbide particles having an average particle size of between about 15 $\mu$m and 30 $\mu$m.

25. A rock bit as recited in claim 20 wherein the carbide component consists essentially of about 35 percent by weight spherical cemented carbide particles having a particle size between about 75 $\mu$m and 300 $\mu$m, 45 percent by weight spherical cast carbide particles having a particle size between about 75 $\mu$m and 150 $\mu$m, and 20 percent by weight carburized carbide particles having an average particle size of between about 15 $\mu$m and 30 $\mu$m.

26. A rock bit as recited in claim wherein the carbide component consists essentially of about 40 percent by weight spherical cemented carbide particles having a particle size between about 420 $\mu$m and 590 $\mu$m, 50 percent by weight spherical cast carbide particles having a particle size between about 75 $\mu$m and 150 $\mu$m, and 10 percent by weight carburized carbide particles having an average particle size of between about 15 $\mu$m and 30 $\mu$m.

* * * * *

UNITED STATES PATENT AND TRADEMARK OFFICE

CERTIFICATE OF CORRECTION

PATENT NO. : 5,921,330
DATED : July 13, 1999
INVENTOR(S) : Jiinjen Albert Sue; Zhlgang Fang; Alysia C. White It is certified that error appears in the above-identified patent and that said Letters Patent is hereby corrected as shown below:

Column 12, line 25, replace "in claim wherein" with -- in claim 20 wherein --.

Signed and Sealed this

Tenth Day of April, 2001

*Attest:*

Nicholas P. Godici

NICHOLAS P. GODICI

*Attesting Officer*

*Acting Director of the United States Patent and Trademark Office*